US006184620B1

(12) United States Patent
Mori et al.

(10) Patent No.: US 6,184,620 B1
(45) Date of Patent: Feb. 6, 2001

(54) DISPLAY DEVICE

(75) Inventors: Hiroshi Mori; Kiyohiko Miyahara; Hidehiro Kawaguchi; Suehiro Nakamura, all of Kanagawa (JP)

(73) Assignee: Sony Corporation, Tokyo (JP)

( * ) Notice: Under 35 U.S.C. 154(b), the term of this patent shall be extended for 0 days.

(21) Appl. No.: 09/252,065

(22) Filed: Feb. 18, 1999

(30) Foreign Application Priority Data

Feb. 19, 1998 (JP) ..... 10-037546

(51) Int. Cl.[7] ..... H01J 17/20
(52) U.S. Cl. ..... 313/585; 313/584; 313/581
(58) Field of Search ..... 315/169.4, 581, 315/582, 584, 585, 586

(56) References Cited

U.S. PATENT DOCUMENTS 4,737,687 4/1988 Shinoda et al. .
5,317,231 5/1994 Lee .

FOREIGN PATENT DOCUMENTS 2 176 106 10/1973 (FR) .

*Primary Examiner*—Frank G. Font
*Assistant Examiner*—Andrew H. Lee
(74) *Attorney, Agent, or Firm*—Ronald P. Kananen; Rader, Fishman & Grauer

(57) ABSTRACT

In an alternating-current driving-type display device utilizing the plasma discharge, a discharge maintaining electrode group composed of a plurality of discharge maintaining electrodes (I) and an address electrode group composed of a plurality of address electrodes (J) are formed on one substrate (22), the address electrode group which crosses the discharge maintaining electrode group through an insulator layer (27) and a discharge starting address group from a plurality of discharge starting address electrodes (K) composing a part of the address electrode group are continuously formed at the same time, the discharge maintaining electrode group and the discharge starting address electrode group are formed on the same plane, and a dielectric layer is formed on the discharge maintaining electrode group, the address electrode group and the discharge starting address electrode group.

8 Claims, 14 Drawing Sheets

DISPLAY DEVICE

BACKGROUND OF THE INVENTION

1. Field of the Invention

The present invention relates to an alternating-current driving-type display device utilizing plasma discharge.

2. Description of the Related Art

Heretofore, there has been known an alternating-current driving-type display device using plasma discharge, i.e. so-called AC (alternating-current)-type plasma display panel (Plasma display panel: PDP). As this AC-type PDP, there are such a plasma display panel which is able to display a light emitted by a discharge gas and such a plasma display panel which is able to excite a fluorescent mnaterial by ultraviolet rays generated by the discharging.

Heretofore, there are known conventional color AC-type PDPs which are driven by two-phase electrodes and by three-phase electrodes.

FIG. 1 shows an arrangement of a color AC-type PDP 1 which is driven by three-phase electrodes. FIG. 1 is a perspective view showing a portion which includes a portion corresponding to one pixel. FIG. 2 is a cross-sectional view taken along the line A—A in FIG. 1 which is parallel to the direction in which address electrodes of FIG. 1 are extended. FIG. 3 is a cross-sectional view taken along the B—B in FIG. 1 which is parallel to the direction in which display electrodes of FIG. 1 are extended.

This color AC-type PDP 1 includes a three-electrode structure in which a pair of display electrodes 2, 2 and an address electrode 3 are opposed to each other in a matrix display unit light-emission region, and in which fluorescent materials 4 (4R, 4G, 4B) are formed on the address electrode 3 side.

That is, a plurality of sets (only one set is illustrated in the figure) of the pair of display electrodes 2, 2 are arrayed on a first substrate, e.g. a front glass substrate 5 on the display surface side. A dielectric layer 6 is formed so as to cover the display electrodes 2, 2. Further, an MgO film having a thickness of several 1000s of angstroms is formed on the surface of the dielectric layer 6 as a protecting layer 7. Reference numeral 8 denotes a bus electrode of a low resistance value formed on the display electrodes 2, 2.

On the other hand, the address electrode 3 for causing the unit light-emission region to become luminous selectively is arrayed on a second substrate opposing the front glass substrate 5, e.g. rear glass substrate 10 in the direction perpendicular to the display electrodes 2, 2, e.g. at a pitch of about 200 microns. Further, a dielectric layer 12 is formed so as to cover the address electrodes 3. A stripe-like partition wall 11 having a width of about 100 microns for determining a spacing size of a discharge space is formed between adjacent address electrodes 3, whereby the discharge space is partitioned at every unit light-emission region in the line direction (extended direction of the display electrodes 2, 2). Also, fluorescent materials 4R, 4G, 4B of three colors of red, green and blue are formed between adjacent partition walls 11 by coating. Incidentally, in the discharge space, there is sealed a Penning gas in which xenon is mixed with neon, for example, as a discharge gas for exciting the fluorescent materials 4 (4R, 4G, 4B) with ultraviolet rays.

Each pixel (picture element) comprising the display screen is composed of three unit light-emission regions of red (R), green (G), blue (B) of the same area arrayed on the line direction.

In this color AC-type PDP 1, after a discharge is started between one display electrode 2 of the selected pair of display electrodes 2, 2 and the selected address electrode 3, the discharge is maintained between the pair of display electrodes 2 and 2 and the fluorescent materials 4 (4R, 4G, 4B) are excited to become luminous by the ultraviolet rays generated by plasma discharge produced at that time. Accordingly, by selectively causing each unit light-emission region to become luminous, it becomes possible to present a full color display by a combination of red (R), green (G), blue (B).

By the way, in such color AC-type PDP 1, in order to make the display pixel become high-definition, it is necessary to reduce a distance between the display electrodes 2 and 2. In this connection, it is necessary to make a distance between the address electrode 3 and the display electrode 2 become equal to the distance between the display electrodes 2 and 2.

However, there is a limit on reducing the distance between the display electrodes 2 and 2. Thus, it is difficult to make the display pixel become high-definition.

If the distance between the electrodes 2 and 2 is less than, for example, 20 microns, then when the fluorescent material having a thickness ranging from 20 to 40 microns is formed, a plasma discharge space 14 shown in FIG. 3 is lost. There is then the risk that a discharge destruction will occur between the electrodes.

Also, even considering the arrangement in which the plasma discharge space 14 is maintained, the portion in which the fluorescent materials should be formed is limited. If the fluorescent materials 4 are reduced, then the brightness becomes low. Further, there is the disadvantage that the fluorescent materials are deteriorated by ion bombardment.

SUMMARY OF THE INVENTION

In view of the aforementioned aspect, it is an object of the present invention to provide a high-definition display device.

Further, it is an object of the present invention to provide a display device in which a structure may be simplified and in which a manufacturing process thereof may be facilitated.

According to an aspect of the present invention, there is provided a display device, in which in an alternating-current driving type display device utilizing plasma discharge, a discharge maintaining electrode group, an address electrode group and a discharge starting address electrode group comprising a part of the address electrode group are formed on the same substrate, the discharge maintaining electrode group and the discharge starting address electrode group are formed on the same plane, and the discharge starting address electrodes and the address electrodes are continuously formed at the same time.

In the display device according to the present invention, since the discharge maintaining electrode group, the address electrode group and the discharge start address electrode group are formed on the same substrate, even when the distance between the address electrode and the discharge maintaining electrode is reduced too far, the plasma discharge space may be sufficiently maintained by the partition wall. Accordingly, it becomes possible to make a display pixel become high-definition.

When the fluorescent layer on the opposing substrate side is excited to become luminous by the ultraviolet rays generated by plasma, the ultraviolet rays generated by plasma may be maintained sufficiently so that the fluorescent layer becomes able to be luminous with a high brightness. Also, since the fluorescent layer is disposed in the outside of the plasma and the fluorescent layer is protected from being exposed to the plasma, it is also possible to prevent the fluorescent material from being deteriorated by the ion bombardment of the plasma.

Since the discharge maintaining electrode group, the address electrode group and the discharge starting address electrode group are formed on the same substrate, in the process for forming electrodes, respective electrodes may be positioned with a high alignment accuracy. Thus, in the process for sealing the substrate on the electrode side and the opposing substrate, a tolerance of alignment and space interval may be increased sufficiently. Also, since the discharge maintaining electrode group and the discharge starting address electrode group are formed on the same plane, it is possible to set a distance between a pair of discharge maintaining electrodes and a distance between one discharge maintaining electrode and the discharge starting address electrode with a high accuracy.

Then, since the address electrode and the discharge starting address electrode are continuously formed at the same time, as compared with the arrangement in which the address electrode and the discharge starting address electrode are connected after they were individually formed, the electrode structure may be simplified, and both of them may be conducted reliably. Further, the electrode manufacturing process may be simplified. Accordingly, a yield of display device may be increased, and a cost thereof may be decreased.

DESCRIPTION OF THE PREFERRED EMBODIMENTS

Figure 1:
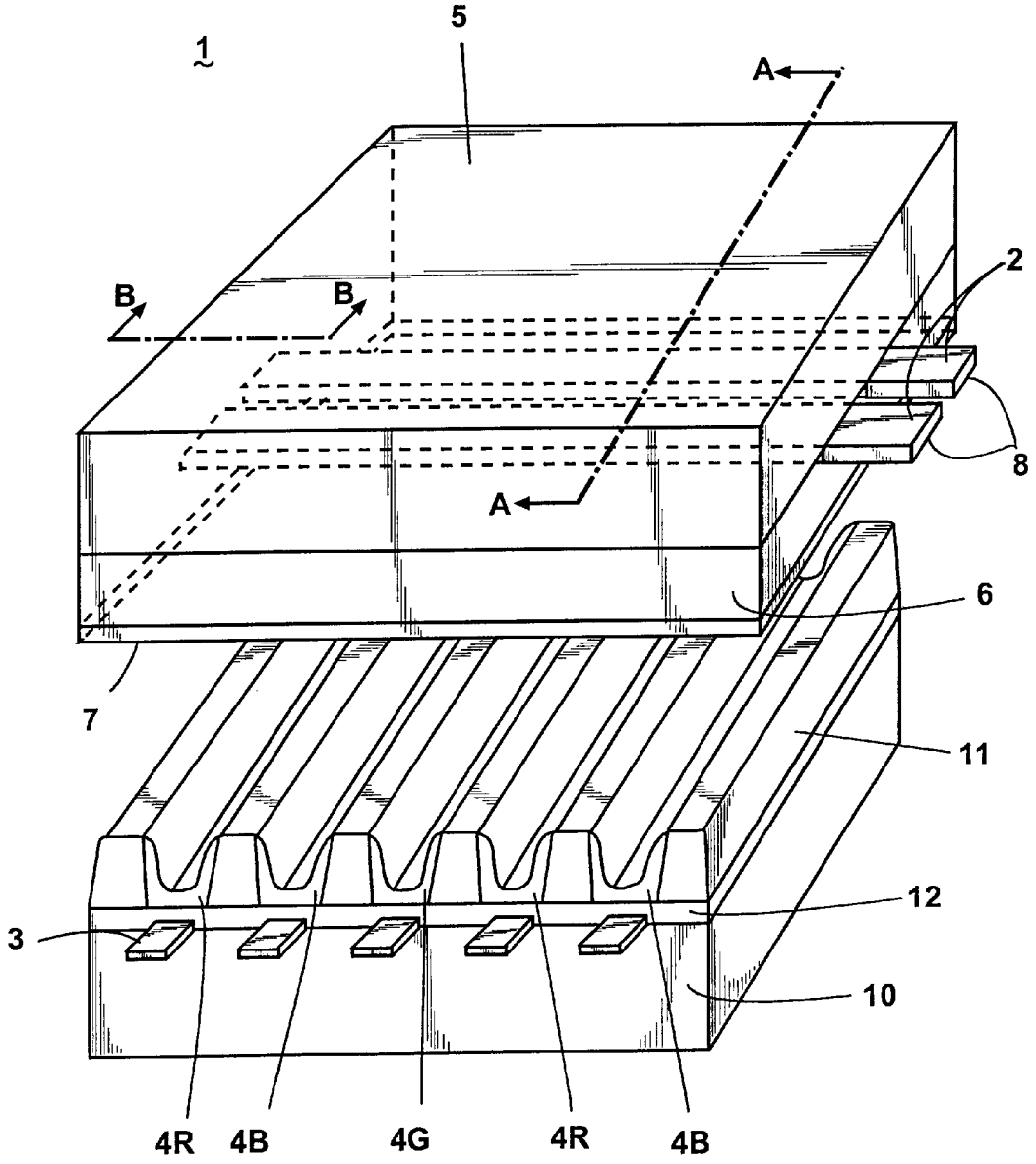
Fig. 1 (PRIOR ART)
FIG. 1 is a diagram showing a conventional AC-type three-phase elcrode PDP.
Figure 2:
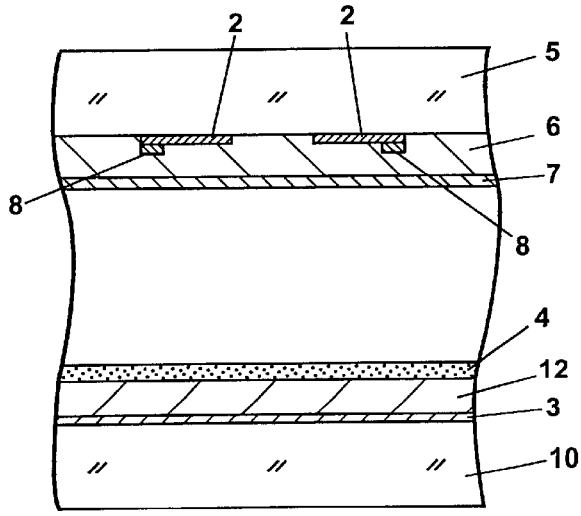
Fig. 2 (PRIOR ART)
FIG. 2 is a cross-sectional view taken along the line A—A in FIG. 1.
Figure 3:
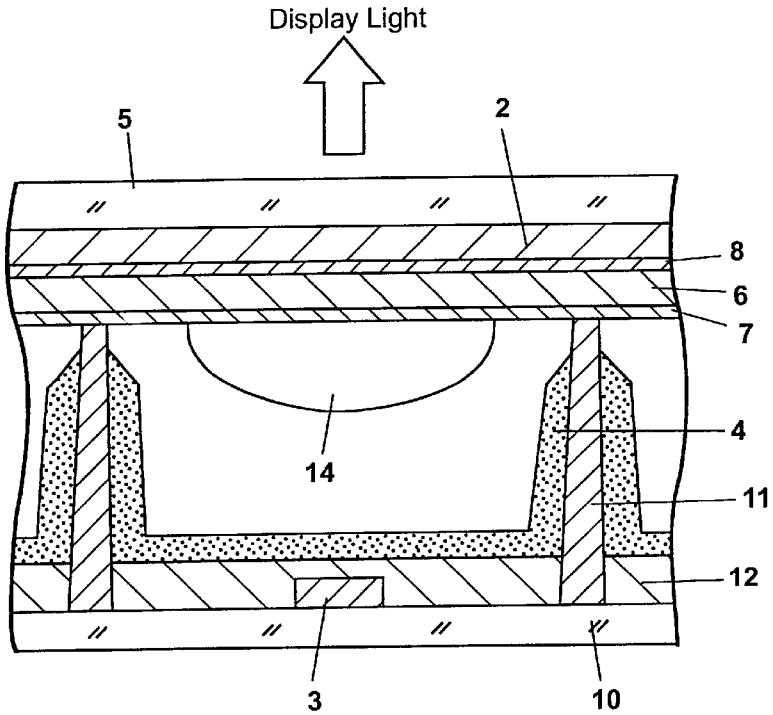
Fig. 3 (PRIOR ART)
FIG. 3 is a cross-sectional view taken along the line B—B in FIG. 1.

First of all, the outline of the present invention will be described.

According to a display device of the present invention, in an alternating-current-driving type display device utilizing plasma discharge, the display device is arranged such that a discharge maintaining electrode group composed of a plurality of discharge maintaining electrodes and an address electrode group composed of a plurality of address electrodes are formed on one substrate, the address electrode group crossing the discharge maintaining electrode group through an insulator layer and a discharge starting address group composed of a plurality of discharge starting address electrodes comprising a part of the address electrode group are continuously formed at the same time, the discharge maintaining electrode group and the discharge starting address electrode group are formed on the same plane, and a dielectric layer is formed on the discharge maintaining electrode group, the address electrode group and the discharge starting address electrode group.

A fluorescent layer which is excited to become luminous by ultraviolet rays generated by plasma discharge may be formed on the other substrate opposing the one substrate. The discharge maintaining electrode group may be formed of a transparent conductive film or Al, Cr, Au, Ag, further a laminated layer of Cr and Al, e.g. Al/Cr two layer structure, Cr/Al/Cr three layer structure or the like.

When the discharge maintaining electrode group is formed of the Cr and Al laminated film, a surface oxide film may be removed from its terminal portion.

The address electrode group and the discharge starting address electrode group may be formed of, for example, a metal material such as Al, Ag and so on.

On the surface of the dielectric layer, there may be formed an MgO film for protecting the dielectric layer and which decreases a work function.

The discharge starting address electrodes on one substrate side may be formed at every unit discharge region, partition walls may be formed on the other substrate, the fluorescent layer may be formed between adjacent partitions, and one substrate and the other substrate may be sealed in such a manner that each partition wall and each address electrode are corresponded to each other.

In the discharge maintaining electrode, a distance between the first and second discharge maintaining electrodes forming the pair may be set to be less than 50 $\mu$m, e.g. 5 $\mu$m to 20 $\mu$m, further less than 5 $\mu$m, and less than 1 $\mu$m.

A distance between the first and second discharge maintaining electrodes forming the pair of the discharge maintaining electrode groups and a distance between the discharge starting address electrode and the discharge maintaining electrode (i.e. one discharge maintaining electrode forming the pair) may be set to be substantially equal to each other, i.e. equal to each other or distances close to each other.

A distance between the discharge maintaining electrodes, i.e. one discharge maintaining electrode forming the pair and the discharge starting address electrode may fall within ±30% of a distance between the first and second discharge maintaining electrodes forming the pair of discharge maintaining electrode groups.

Also, a distance between the first and second discharge maintaining electrodes forming the pair of the discharge maintaining electrode groups and a distance between one discharge maintaining electrode and the discharge starting address electrode may both fall within ±30% of optimum values.

Into an airtight container formed by sealing one substrate and the other substrate, i.e. discharge space, there may be sealed gases of more than one kind of He, Ne, Ar, Xe, Kr in such a manner that a sealed gas pressure becomes 0.8 to 3.0 atm.

A thickness of a dielectric layer on the discharge maintaining electrode and the discharge starting address electrode should preferably be selected to be thinner that a distance between electrodes, i.e. a distance between the first and second discharge maintaining electrodes forming the pair and a distance between one discharge maintaining electrode forming the pair and discharge starting address electrode.

A display device according to the present invention may be applied to any of a color display device and a monochromatic display device.

In the case of the color display device, a set of unit discharge regions (so-called dots) of red, green, blue, for example, form one pixel (picture element). In the case of the monochromatic display device, one unit discharge region (so-called dot) forms one pixel (picture element).

Figure 4:
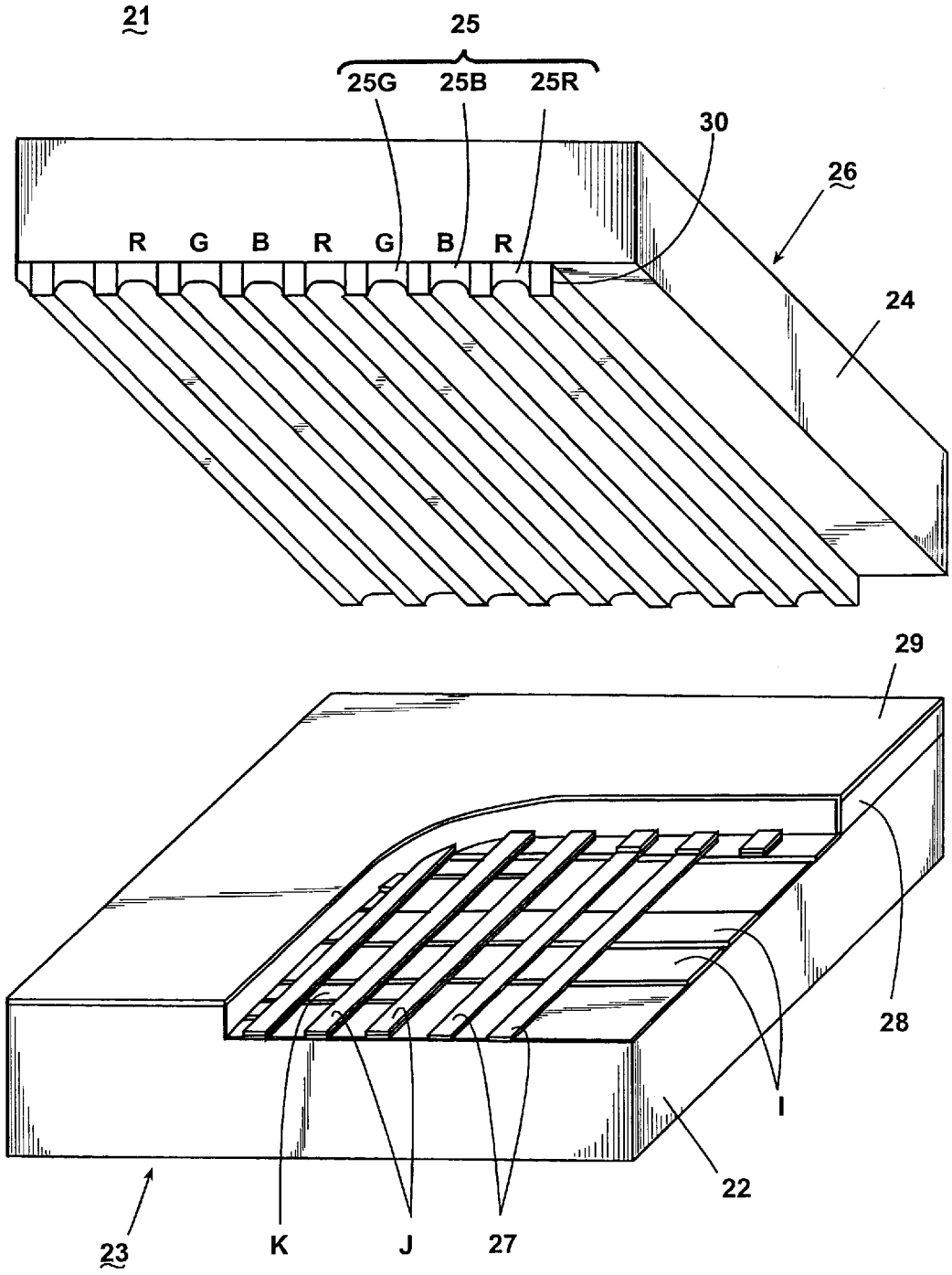
FIG. 4 is a diagram showing a structure of a display device according to an embodiment of the present invention.
Figure 5:
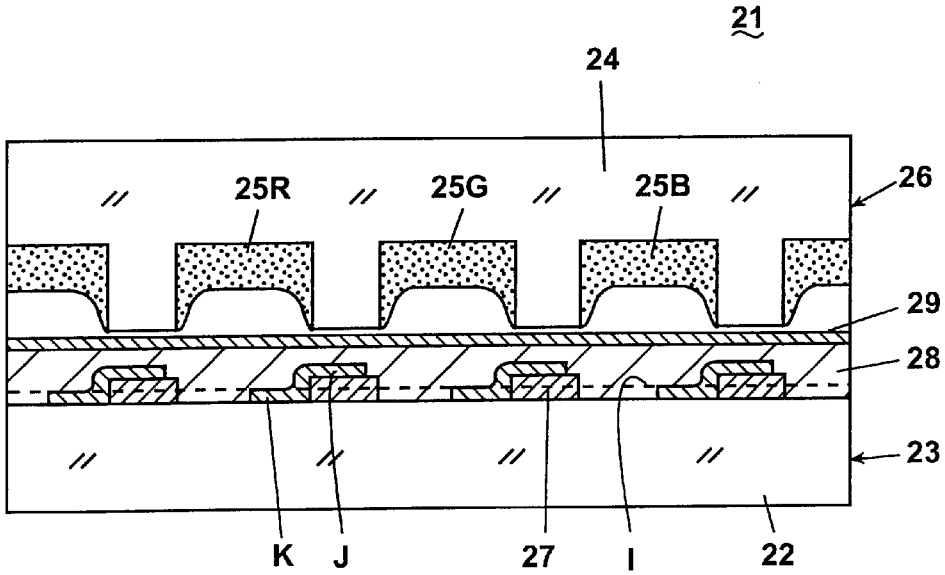
FIG. 5 is a cross-sectional view of the display device according to the embodiment of the present invention.
Figure 8A:
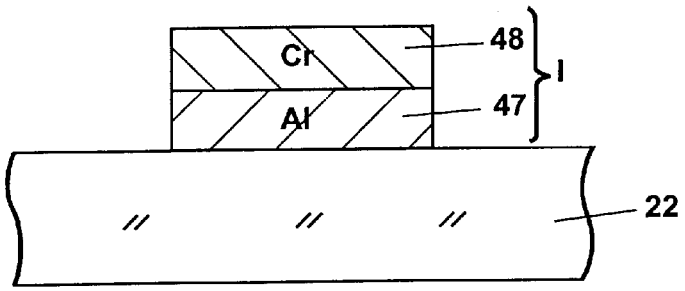
FIG. 8A is a cross-sectional view showing a discharge maintaining electrode of an Al/Cr two layer film structure applied to a display device according to other embodiment of the present invention.
Figure 8B:
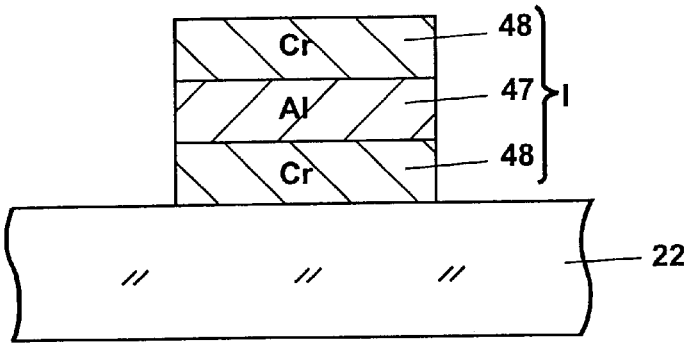
FIG. 8B is a cross-sectional view showing a discharge maintaining electrode of a Cr/Al/Cr three layer film structure applied to a display device according to other embodiment of the present invention.
Figure 6:
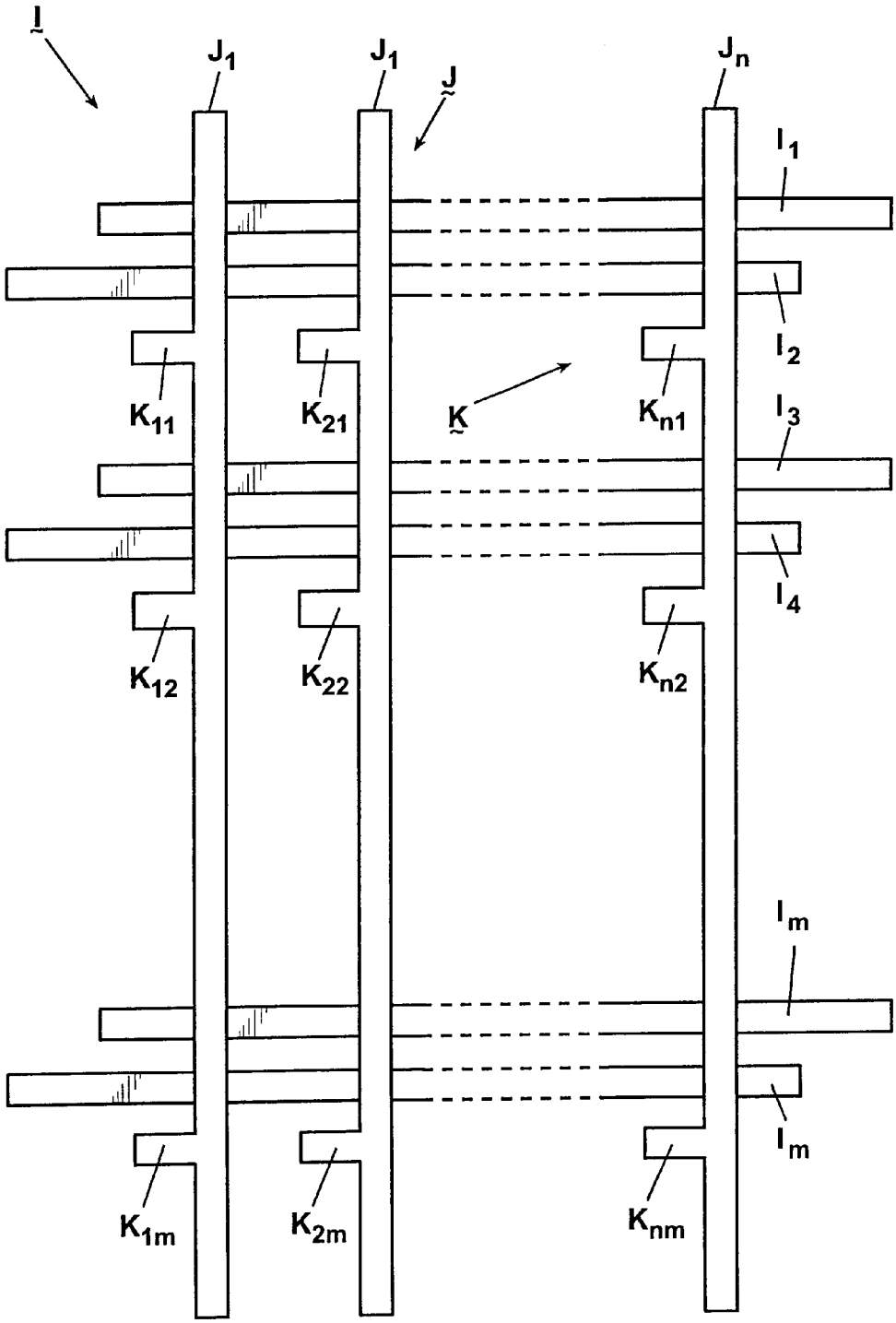
FIG. 6 is a plain view showing an electrode structure of the display device according to the embodiment of the present invention.

FIGS. 4 to 6 show a display device according to an embodiment of the present invention. In this embodiment, the present invention is applied to a color AC-type display device.

In this display device 21, a so-called electrode substrate 23 is formed by forming a discharge maintaining electrode group composed of a plurality of stripe-like discharge maintaining electrodes ($I_1$, $I_2$, . . . $I_m$, an address electrode group composed of a plurality of stripe-like address electrodes ($J_1$, $J_2$, . . . $J_n$,) and a discharge starting address electrode group composed of a plurality of discharge starting address electrodes ($K_{11}$, $K_{21}$, . . . $K_{nl}$, $K_{12}$, . . . $K_{n2}$, . . . $K_{1m}$, . . . $K_{nm}$) forming a part of each address electrode on a first insulating substrate (e.g. glass substrate) which serves as one substrate. A so-called fluorescent substrate 26 in which a fluorescent layer 25 is formed on a second insulating substrate (e.g. glass substrate) 24 serving as the other substrate opposing the electrode substrate 23 is formed. These electrode substrate 23 and fluorescent substrate 26 are sealed airtight to form the display device.

The discharge maintaining electrode groups are, as shown in FIG. 6, arrayed on the surface of the substrate 22 in such a manner as to form a pair of discharge maintaining electrodes $I_1$, and $I_2$, $I_3$ and $I_4$, . . . , $I_{m-1}$ and $I_m$ for maintaining a discharge after the discharge was started.

The respective address electrodes $J_1$, . . . $J_n$ of the address electrode group are electrodes for designating display addresses, and are arrayed at a predetermined interval crossing the discharge maintaining electrode group, along the longitudinal direction of the discharge maintaining electrodes ($I_1$, $I_2$, . . . $I_m$).

The respective discharge starting address electrodes K ($K_{11}$, . . . $K_{nm}$) of the discharge starting address electrode group are electrodes to start discharge between them and one of electrodes of the discharge maintaining electrodes ($I_1$, $I_2$), ($I_3$, $I_4$), . . . ($I_{m-1}$, $I_m$), e.g. discharge maintaining electrodes $I_2$, $I_4$, . . . $I_m$ and are arrayed in response to the respective unit light-emission regions.

The discharge starting address electrodes K ( $K_{11}$, . . . $K_m$) are continuously and unitarily formed from the respective corresponding address electrodes ($J_1$, . . . $J_n$)

That is, the address electrode $J_1$ and the discharge starting address electrodes $K_{11}$, $K_{12}$, . . . $K_{1m}$ are formed together as one body, the address electrode $J_2$ and the discharge starting address electrodes $K_{21}$, $K_{22}$, . . . $K_{2m}$ are formed together as one body, . . . , an the address electrode in and the discharge starting address electrodes $K_{n1}$, $K_{n2}$, . . . $K_{nm}$ are formed together as one body.

Figure 7:
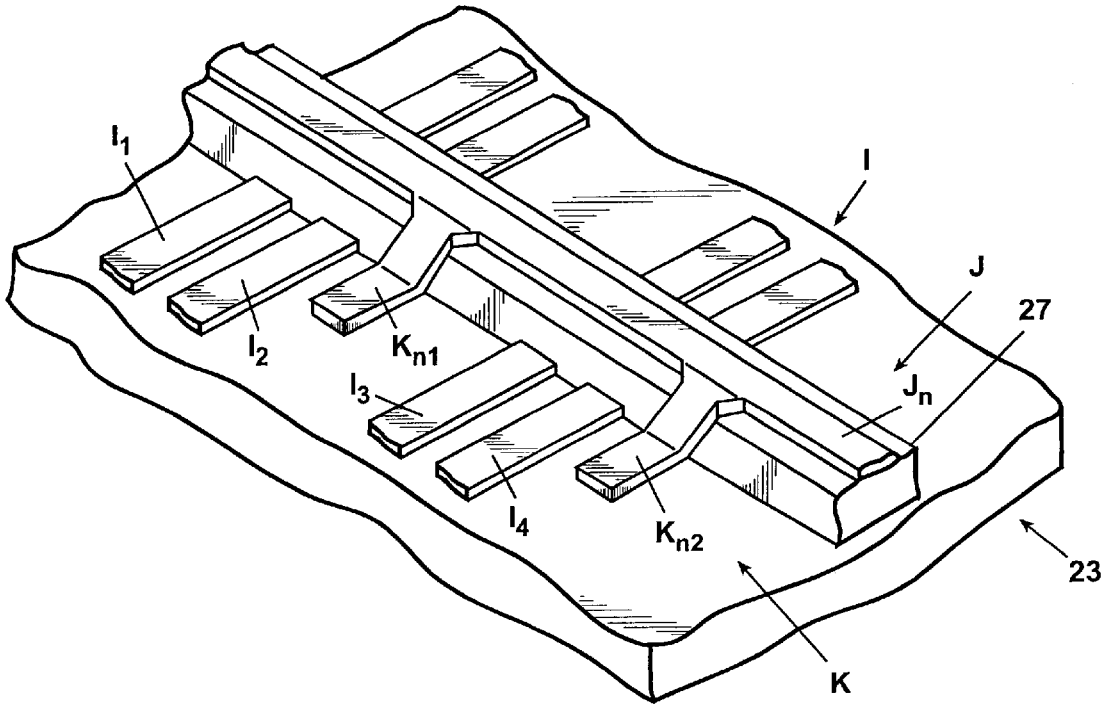
FIG. 7 is a perspective view showing a main portion of the electrode structure of FIG. 6.

As shown in FIGS. 6 and 7, the address electrodes J ($J_1$, . . . $J_n$) are formed so as to cross, e.g. become perpendicular to the discharge maintaining electrodes I ($I_1$, . . . $I_m$) through a stripe-like insulator layer 27 in such a manner that they become electrically insulated from the discharge maintaining electrodes I ($I_1$, . . . $I_m$). The discharge starting address electrodes K ($K_{11}$, . . . $K_{nm}$) which are formed with the address electrodes J ($J_1$, . . . $J_n$) as one body are extended on the surface of the substrate 22 so as to oppose the corresponding discharge maintaining electrodes $I_2$, $I_4$, . . . $I_m$ along the side surface of the insulator layer 27.

Accordingly, the discharge maintaining electrodes I ($I_1$, . . . $I_m$) and the discharge starting address electrodes K ($K_{11}$, . . . $K_{nm}$) are formed on the same surface of the substrate 22.

A dielectric layer 28 having a predetermined thickness is formed on the whole surface including the discharge maintaining electrodes I ($I_1$, . . . $I_m$), the address electrodes (J $J_1$, . . . $J_n$) and the discharge starting address electrodes K ($K_{11}$, . . . $K_{nm}$). An oxide magnesium (MgO) film 29 which is able to lower a discharge starting voltage by reducing a work function is formed on the surface of the dielectric layer 28 as a protecting film. In this case, the MgO film 28 may be formed on the surface of the dielectric layer except the stripe-like address electrodes $J_1$, . . . $J_n$ in order to protect the address electrodes $J_1$, . . . $J_n$ from discharge.

Figure 9:
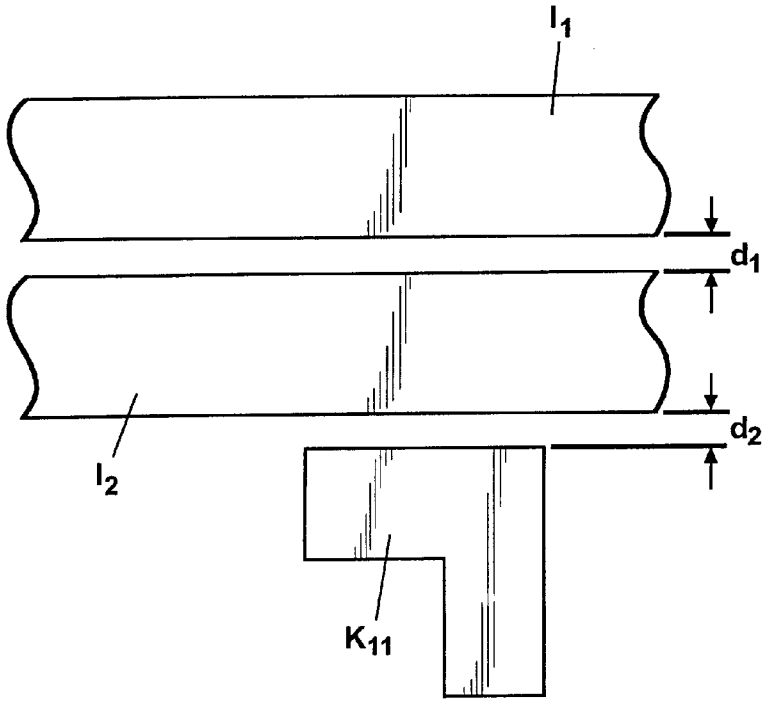
FIG. 9 is a plan view used to explain an electrode distance between a discharge mintaining electrode and a discharge starting address electrode.

Then, as shown in FIG. 9, a distance $d_1$ between the discharge maintaining electrodes forming each pair, and a distance $d_2$ between one discharge maintaining electrode thereof and the discharge starting address electrode opposing thereto are set to be distances substantially equal to each other (i.e. distances equal to each other or distances close to each other).

The distance $d_2$ between one of the discharge maintaining electrodes and the discharge starting address electrode may fall within ±30% of the distance $d_1$ between the discharge maintaining electrodes forming the pair.

As shown by the following Expression (1), a pressure of sealed gas, which will be described later on, should be set in such a manner that a product of a sealed gas pressure P and the discharge electrode distance d may become constant from Paschen's law.

$$Pd=constant \quad (1)$$

The distance $d_2$ may fall within ±30% of that distance when the sealed gas pressure is made constant and the discharge starting voltage is set to a Paschen minimum value.

Also, the electrode distances $d_1$ and $d_2$ may both fall within a tolerance of ±30% of optimum values (equivalent to distances obtained when the discharge starting voltage is set to the Paschen minimum value).

The distance $d_1$ between the pair of discharge maintaining electrodes $I_1$ and $I_2$, $I_3$ and $I_4$, . . . , $I_{m-1}$ and $I_m$ may be set to less than 50 μm, e.g. 5 μm to 20 μm, further less than 5 μm, less than 1 μm. The distance $d_2$ is determined depending upon the value of this distance $d_1$.

When a film thickness of the film functioning as the dielectric layer, i.e. the MgO film 29 is extremely thin and hence is neglected, a film thickness $t_1$ of the dielectric layer 28 should be selected to be thinner than the distance $d_2$ between the discharge starting address electrode and one of the discharge maintaining electrodes on the same surface and the distance $d_1$ between the pair of discharge maintaining electrodes.

Figure 10A:
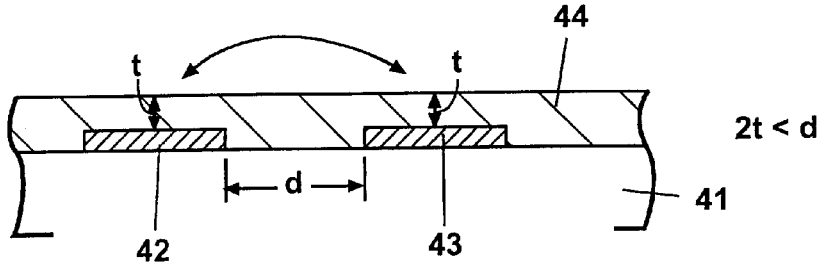
FIGS. 10A and 10B ar iagrams used to explain a relationship between an electrode distance between discharge electrodes and a thickness of a dielectric layer.

That is, as shown in FIG. 10A, when a pair of discharge electrodes 42 and 43 are formed on a substrate 41 and a dielectric layer 44 is formed on the discharge electrodes 42 and 43, if a distance between the discharge electrodes 42 and 43 is assumed as d, a thickness of the dielectric layer 44 on the respective discharge electrodes 42 and 43 is assumed as t and $2t<d$ is satisfied, then discharge between the two electrodes 42 and 43 may occur on the dielectric layer 44.

Figure 10B:
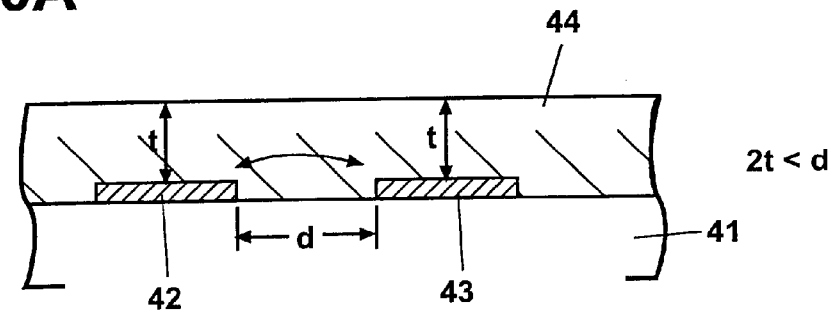

On the other hand, as shown in FIG. 10B, if the thickness t of the dielectric layer 44 is large to satisfy $2t>d$, then discharge between the two electrodes 42 and 43 occurs within the dielectric layer 44 and a dielectric breakdown occurs between the two electrodes 42 and 43. Accordingly, in this embodiment, a film thickness $t_1$ of the dielectric layer 28 is set to be thinner than the distances $d_2$ and $d_1$, i.e. so as to satisfy inequalities $2t_1<d_2$, $2t_1<d_1$.

Figure 11:
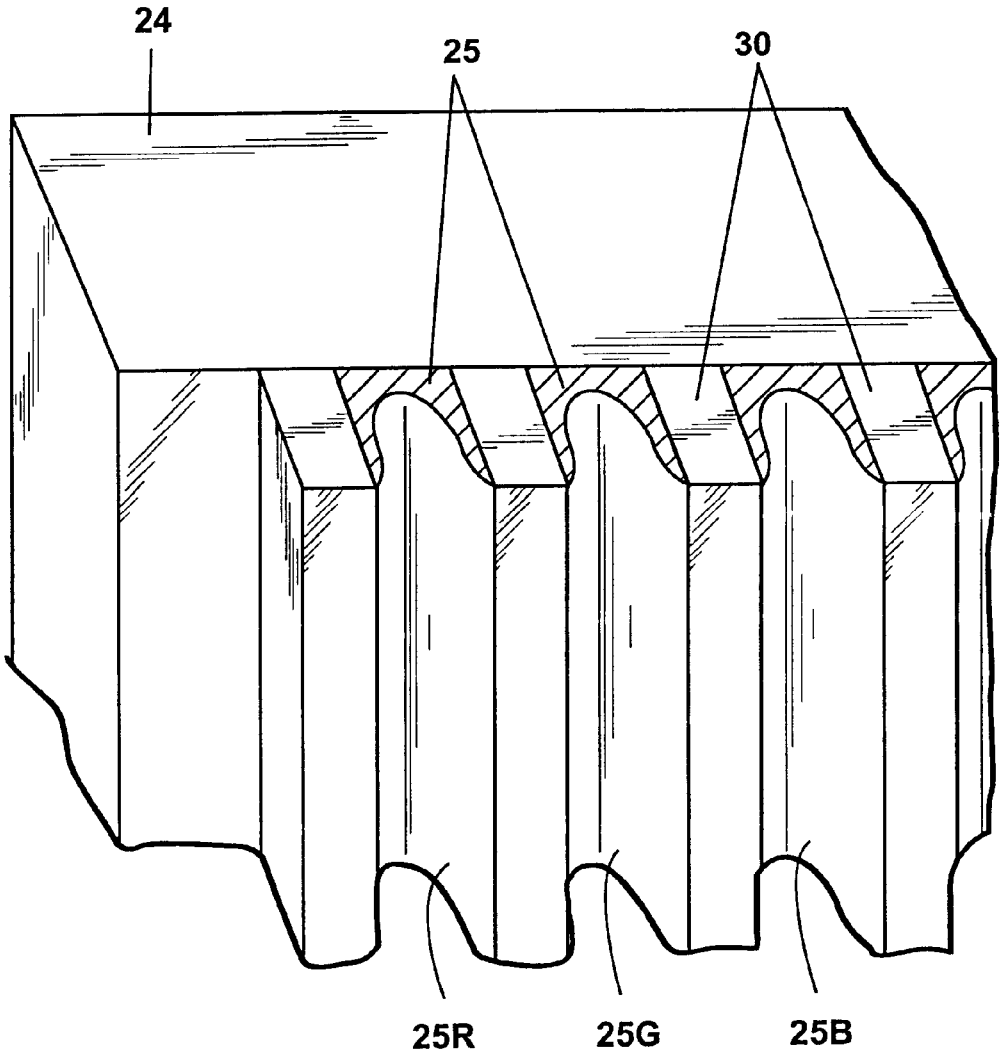
FIG. 11 is a perspective view showing a structure of a fluorescent surface according to an embodiment of the present invention.

On the other hand, as shown in FIGS. 5 and 11 a plurality of stripe-like partition walls 30 are unitarily formed with the second insulating substrate 24 so as to partition columns of respective adjacent unit discharge regions, and the fluorescent layer 25 is deposited within the adjacent partition walls 30. That is, a red (R) fluorescent layer 25R, a green (G) fluorescent layer 25G and a blue (B) fluorescent layer 25B are formed repeatedly, in that order. The width of the partition wall 30 is formed larger than that of the address electrodes ($J_1$, . . . $J_n$) as shown in FIG. 5.

Then, the so-called fluorescent substrate 26 in which the fluorescent layer 25 is formed on the second insulating substrate 24 and the so-called electrode substrate 23 in which the discharge maintaining electrode group, the address electrode group and the discharge starting electrode group are formed on the first insulating substrate 22 are sealed together in such a manner that the respective partition walls 30 are placed on the respective address electrodes $J_1$, . . . $J_n$. A predetermined gas is sealed into the airtight container comprised of the two substrates 26 and 23, i.e. inside the discharge space.

As the sealed gas, there may be used gases of more than one kind of He, Ne, Ar, Xe, Kr. For example, a Penning gas made of a mixed gas such as neon (Ne)/xenon (Xe)/argon (Ar)/xenon (Xe) or the like is used mainly.

The surface of the partition wall 30 may be made black in order to increase a contrast when an image is displayed.

An operation of such display device will be described next.

When the discharge maintaining voltage for maintaining discharge is applied to the pair of discharge maintaining electrodes $I_1$ and $I_2$ and the discharge starting voltage higher than the discharge maintaining voltage for starting discharge is applied through the address electrode $J_1$ to the discharge starting address electrode $K_{11}$ and one discharge maintaining electrode $I_2$, after discharge was started between one discharge maintaining electrode $I_2$ and the discharge starting address electrode $K_{11}$, plasma is produced by discharge generated between the pair of discharge maintaining electrodes $I_1$ and $I_2$ and the fluorescent layers 25 (25R, 25G, 25B) of the corresponding portion are excited to become luminous by ultraviolet rays generated by the plasma. Accordingly, by selecting the respective address electrodes $J_1$, $J_2$, . . . $J_n$ and applying the discharge starting voltage in that order and also applying the discharge maintaining voltage to the pair of discharge maintaining electrodes $I_1$ and $I_2$, $I_3$ and $I_4$, . . . $I_{m-1}$ and $I_m$ of rows in that order, there may be presented a predetermined color display.

That is, in the discharge region of one pixel, the three fluorescent layers 25R, 25G and 25B of red (R), green (G) and blue (B) provided between the partition walls 30 are excited to become luminous in respective color with irradiation of ultraviolet rays generated based on the plasma discharge, thereby resulting in a color display being made.

Here, in order to cause discharge to occurs in pixels at a predetermined address position so that pixels become luminous, a pulse, for example, is applied to address electrodes ($J_1$, . . . $J_n$), whereby discharge is started between the discharge starting address electrodes ($K_{11}$, . . . $K_{nm}$) of pixels at this position and one discharge maintaining electrodes ($I_2$, $I_4$, . . . $I_m$).

When a displayed is viewed from the electrode substrate 23 side in the display device 21, it is desired that the discharge maintaining electrodes $I_1$, $I_2$, . . . $I_m$ should be formed of a transparent conductive film. Also, when the displayed is viewed from the fluorescent substrate 26 side, the discharge maintaining electrodes $I_1$, $I_2$, . . . $I_m$ may be formed of a metal or the like having a low resistance value to reflect light.

In the display device 21, after the discharge maintaining electrodes ($I_1$, . . . $I_m$) were formed on the substrate 23, when the stripe-like insulator layer 27 is formed by firing a glass paste, for example, there is then the risk that the discharge maintaining electrodes ($I_1$, . . . $I_m$) will be oxidized at that firing temperature (approximately 600° C.).

Accordingly, in view of the above-mentioned aspect, according to other embodiment of the present invention, it is desired that the discharge maintaining electrodes ($I_1$, . . . $I_m$) should be formed of a laminated layer of Cr and Al, e.g. Al/Cr two layer film structure in which a lower layer is an Al film 47 and an upper layer is a Cr film 48 as shown in FIG. 5A or a Cr/Al/Cr three layer film structure in which the Al film 47 is sandwiched by upper and lower Cr films 48 as shown in FIG. 5B, for example.

An example of a manufacturing method of the display device 21 in which the discharge maintaining electrodes $I_1, \ldots I_m$ are made of a laminated layer of Cr and Al will be described next.

FIGS. 12 to 15 show manufacturing processes of the electrode substrate 23.

Figure 12A:
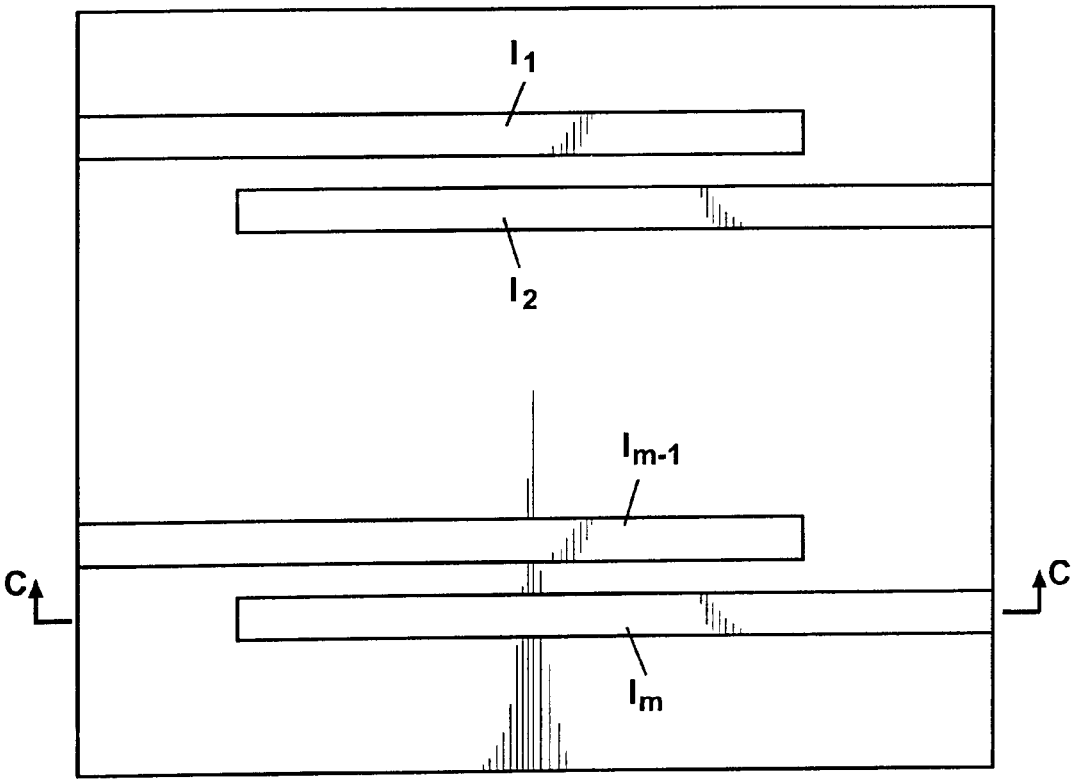
FIG. 12 is manufacturing process diagrams of an electrode substrate of a display device according to other embodiment of the present invention in which A is a plan view and B is a cross-sectional view taken along the line C—C in FIG. 12A.
Figure 12B:
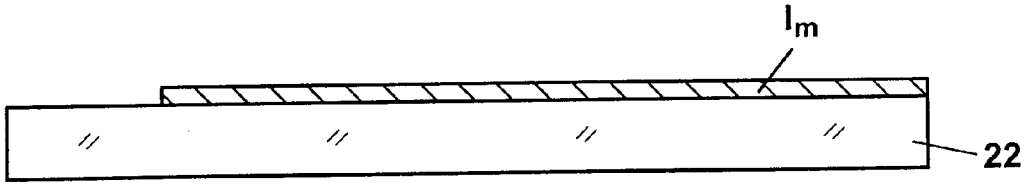

Initially, as shown in FIGS. 12A and 12B, on one surface of the first substrate, e.g. the glass substrate 22, there are formed discharge maintaining electrodes ($I_1, \ldots I_m$) of the Al/Cr two layer film structure or the Cr/Al/Cr three layer film structure, for example.

Figure 13A:
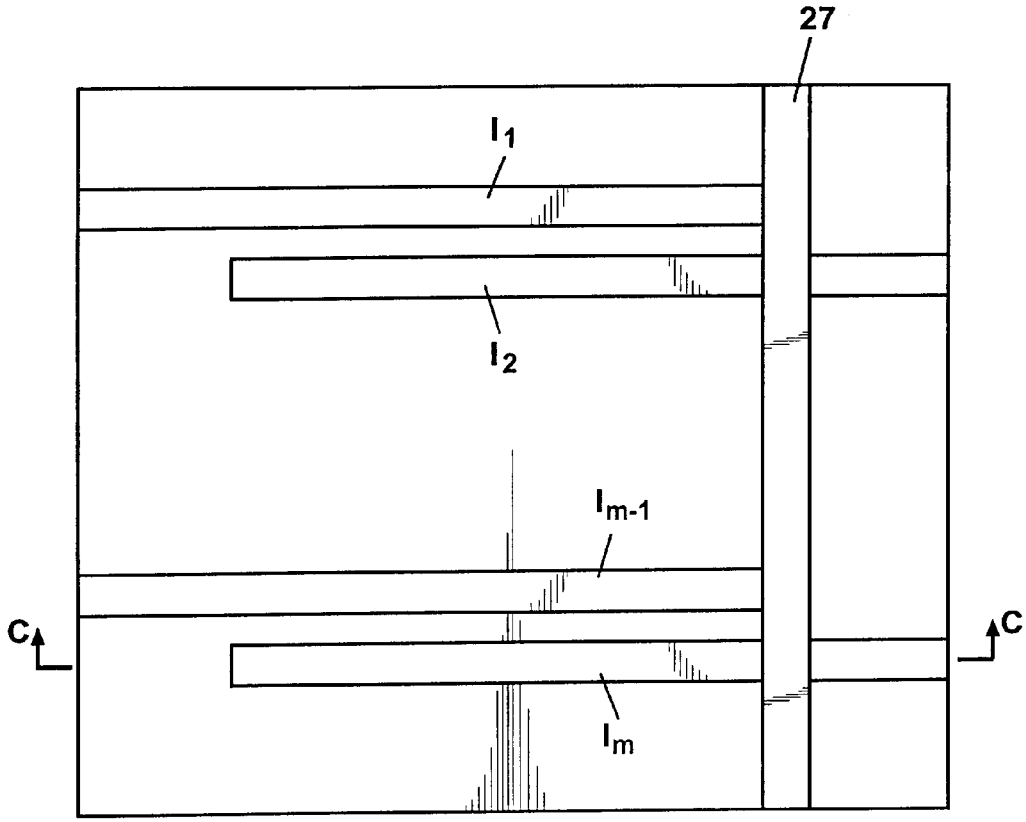
FIG. 13 is manufacturing process diagrams of an electrode substrate of a display device according to other embodiment of the present invention in which A is a plan view and B is a cros-ssectional view taken along the line C—C of FIG. 13A.
Figure 13B:
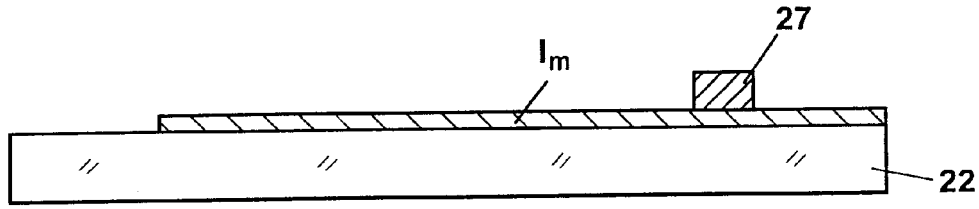

Then, as shown in FIGS. 13A and 13B, the stripe-like insulator layer 27 is formed at an address electrode forming position so as to cross the discharge maintaining electrodes ($I_1, \ldots I_m$)

This insulator layer 27 is formed in such a manner that a photosensitive glass paste is coated, for example, on the whole surface (80° C., 20 minutes), exposed, developed and fired at approximately 600° C.

In the firing process of the insulator layer 27, only the surface of the Cr film 28 of the upper layer of the discharge maintaining electrodes ($I_1, \ldots I_m$) is oxidized. There is then caused no disadvantage that the whole of the discharge maintaining electrodes ($I_1, \ldots I_m$) is oxidized to produce a bad conductor.

Figure 14A:
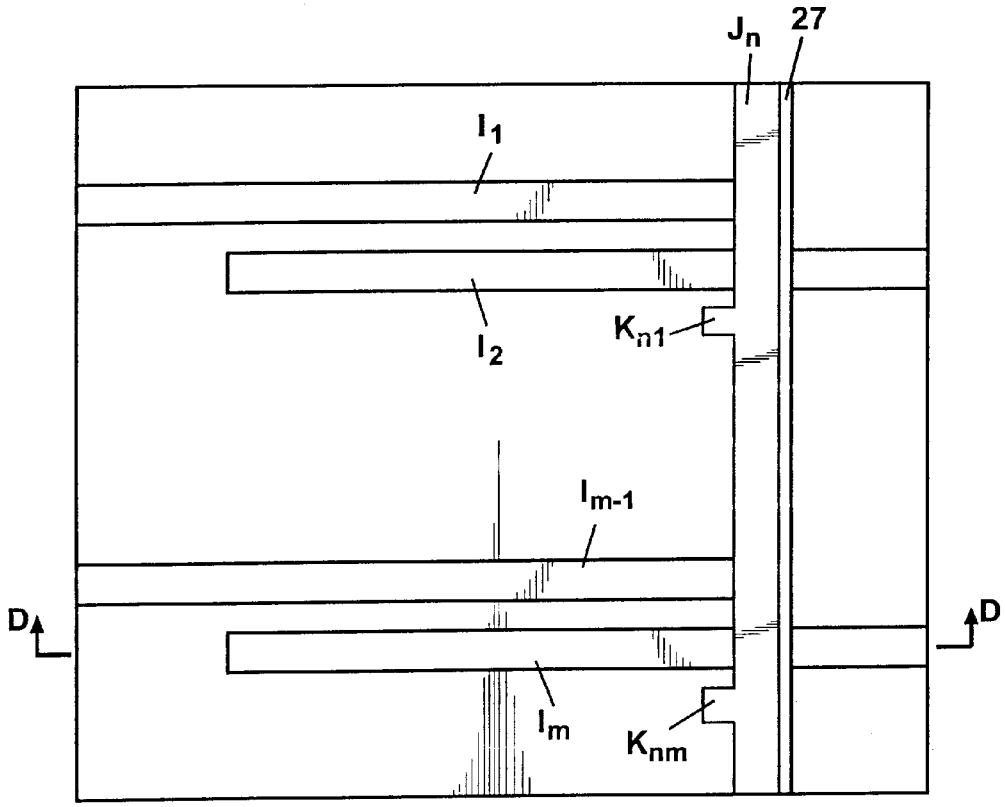
FIG. 14 is manufacturing process diagrams of an electrode substrate of a display device according to other embodiment of the present invention in which A is a plan view and B is a cross-sectional view taken along the line D—D in FIG. 14A.
Figure 14B:
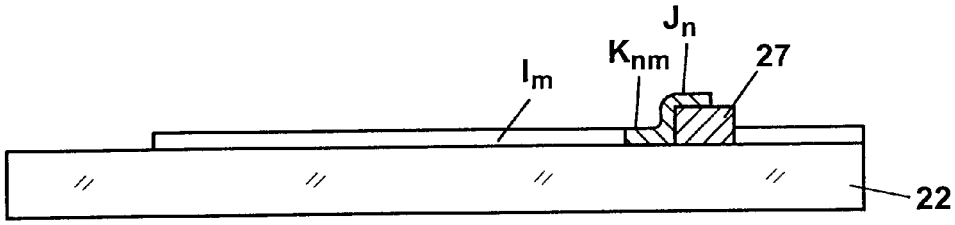

Then, as shown in FIGS. 14A and 14B, on the insulator layer 27 and over a part of the surface of the glass substrate 22, there are formed the address electrodes ($J_1, \ldots J_n$) of Al film, for example, and discharge starting address electrodes ($K_{11}, \ldots K_n$) continuous thereto simultaneously by the same process.

Figure 15A:
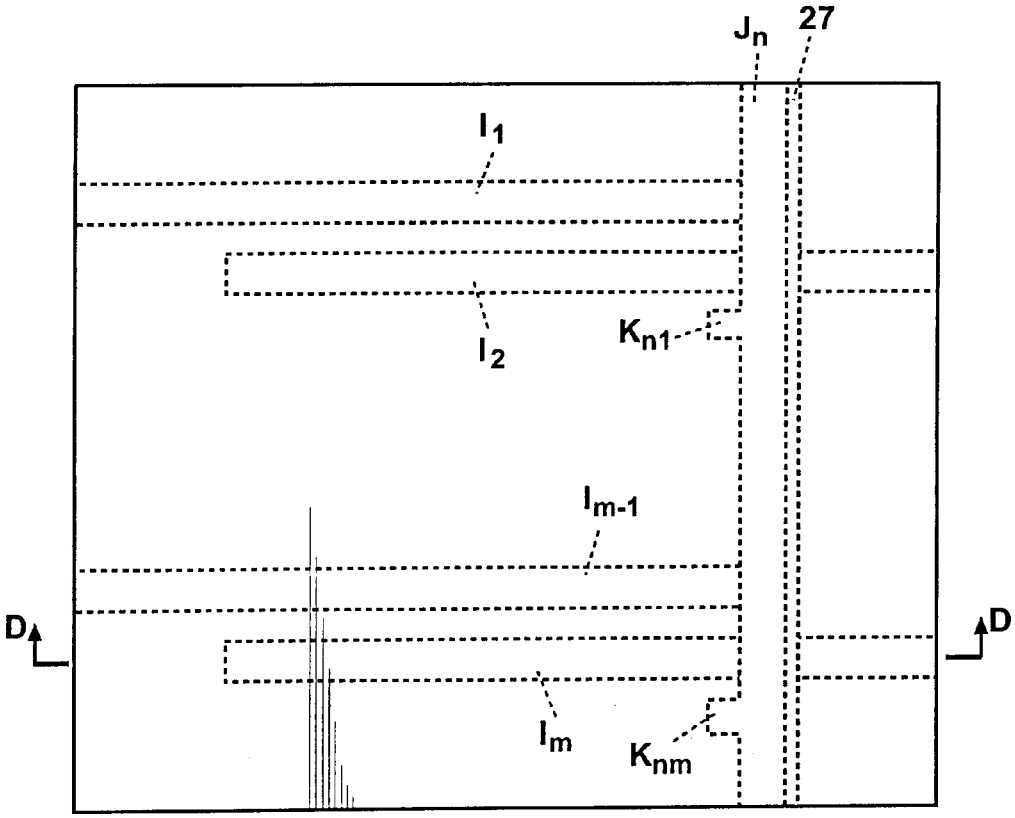
FIG. 15 is manufacturing process diagrams of an electrode substrate of a display device according to other embodiment of the present invention in which A is a plan view and B is a cross-sectional view taken along the line D—D in FIG. 15A.
Figure 15B:
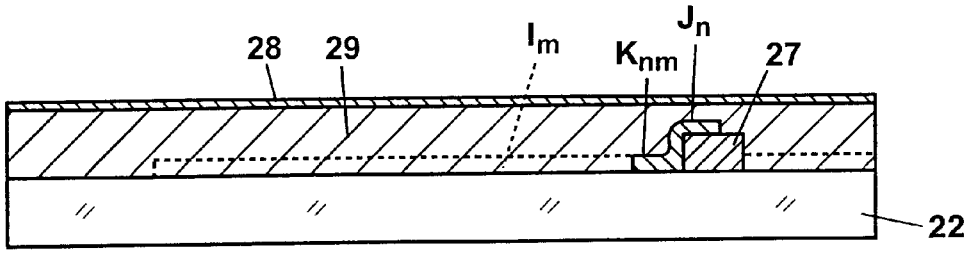

That is, the stripe-like address electrodes $J_1, \ldots J_n$ are formed on the stripe-like insulator layer 27, and the discharge starting address electrodes $J_{ll}, \ldots J_{nm}$ are formed on the surface of the glass substrate along the side surface of the insulator layer from the address electrodes $J_1, \ldots J_{nm}$ to the positions opposing the discharge maintaining electrodes $I_2$, $I_4, \ldots$ Then as shown in FIG. 15A and 15B, the dielectric layer 28 is formed on the whole surface on the display region except at least terminal portions (not shown) of the discharge maintaining electrodes ($I_1, \ldots I_m$) and terminal portions (not shown) of the address electrodes ($J_1, \ldots J_m$). Further, the MgO film 29 serving as the protecting film is formed on the dielectric layer, whereby the electrode substrate 23 is formed.

On the other hand, although not shown, the partition walls 30 are formed on the second substrate, e.g. glass substrate 24, and there is formed the fluorescent substrate 26 in which the fluorescent layer 25 (25R, 25G, 25B) is formed within each partition wall 30.

Figure 16A:
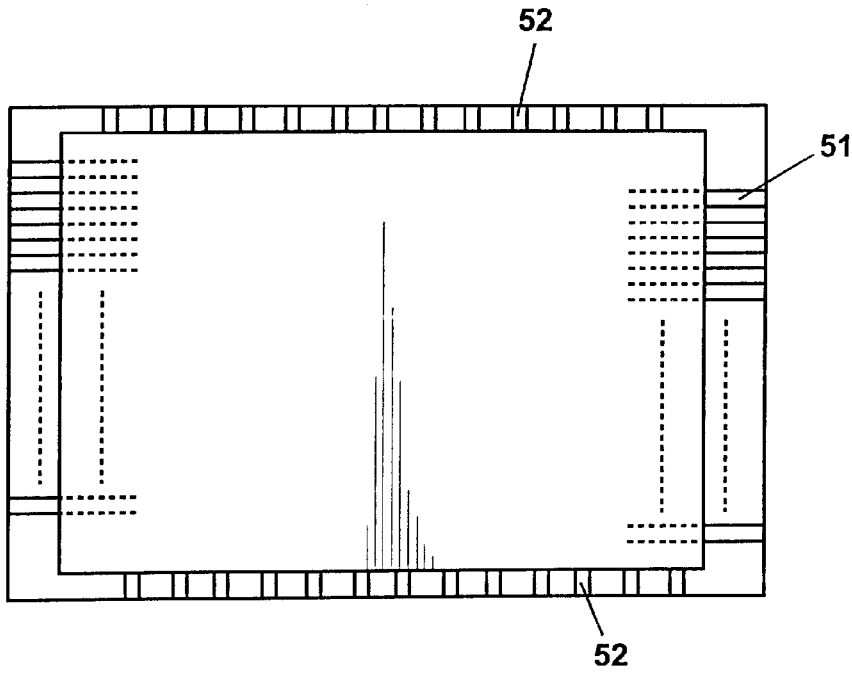
FIG. 16 is manufacturing process diagrams of a display device according to other embodiment of the present invention in which A is a plan view and B is a side view of a main portion.
Figure 16B:
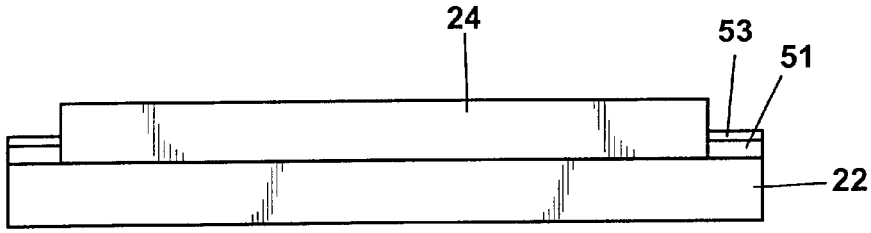

Then, as shown in FIGS. 16A and 16B, the electrode substrate 23 and the fluorescent substrate 26 are positioned accurately such that the respective partition walls 30 are made coincident with the positions of the respective address electrodes $J_1, \ldots J_m$, and their surrounding portions are sealed airtight by glass fritting in such a manner that a terminal portion 51 of the discharge maintaining electrodes ($I_1, \ldots I_m$) and a terminal portion 52 of the address electrodes ($J_1, \ldots J_n$) are faced to the outside. Then, the discharge space in the inside of the airtight container is evacuated and the aforementioned discharge gas is sealed into the evacuated discharge space and a chip is off.

Figure 17:
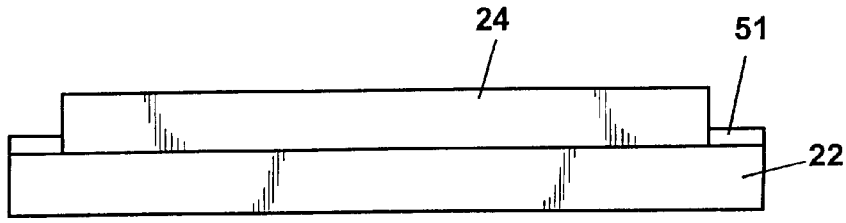
FIG. 17 is a manufacturing process diagram (a side view of a main portion) of a display device according to other embodiment of the present invention.

After the surrounding portions were sealed by glass fritting, as shown in FIG. 17, an oxide film 53 on the surface of the terminal portion 51 of the discharge maintaining electrodes $I_1, \ldots I_m$) facing to the outside is removed.

Figure 18A:
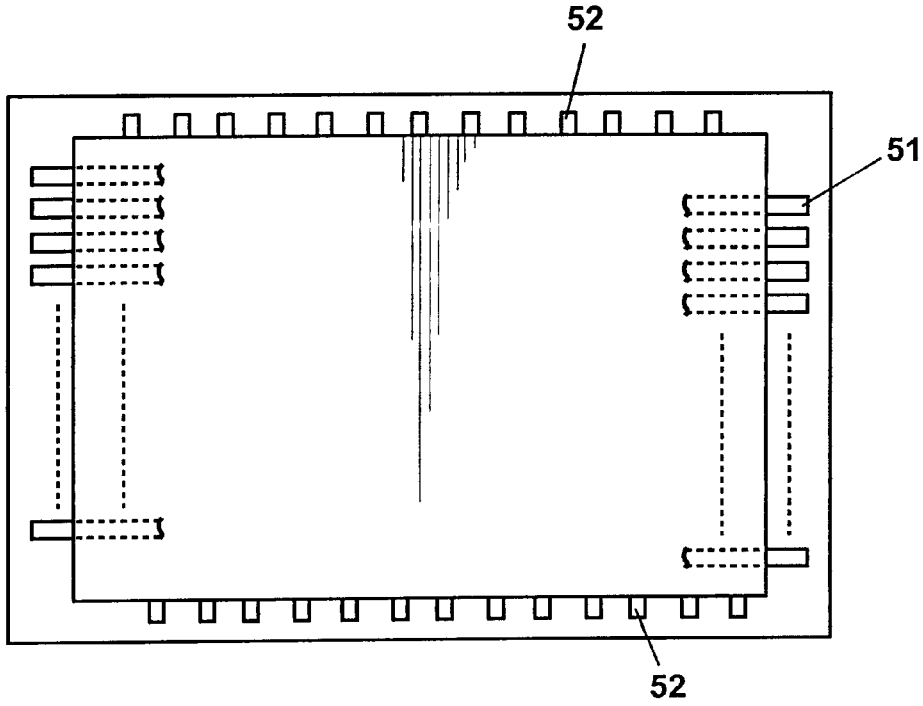
FIG. 18 is manufacturing process diagrams of a display device according to other embodiment of the present invention in which A is a plan view and B is a side view of a main portion.
Figure 18B:
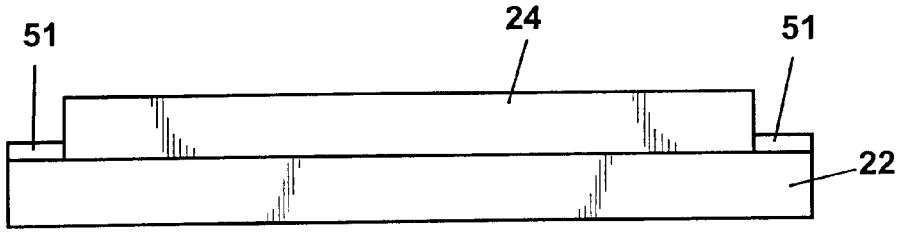

In this manner, as shown in FIGS. 18A and 18B, there may be obtained the target display device 21 in which the discharge maintaining electrodes ($I_1, \ldots I_m$) are formed of the Cr and Al laminated layer, sealed and then the oxide film 53 on the surface of the terminal portion 51 is removed.

In the display device 21 of FIG. 18, the direction in which a displayed is viewed is the fluorescent substrate 26 side. In this case, if a reflecting film made of an Al film or the like is formed on the electrode substrate 23 side, for example, an Al film (reflecting film) is deposited on the whole surface of the inner surface of the glass substrate 22 and the discharge maintaining electrodes ($I_1, \ldots I_m$) or the like are formed on this Al film through the insulator film, then of emitted light, light traveling toward the electrode substrate 23 side is reflected on the reflecting film and introduced toward the fluorescent substrate 26 side so that the viewer may watch a displayed image with an increased brightness from the fluorescent substrate 26 side.

According to the above-mentioned display device 21, since the discharge maintaining electrode groups ($I_1$, $I_2, \ldots I_m$), the discharge starting address electrode groups ($K_{11}, \ldots K_{nm}$) and the address electrode groups ($J_1$, $J_2, \ldots J_n$) are formed on the same substrate, i.e. the first substrate 22 and the fluorescent layer 25 is formed on the second substrate 24 opposing this first substrate 22, even when the electrode distance d1 between the respective pairs of discharge maintaining electrodes $I_1$ and $I_2$, $I_3$ and $I_4, \ldots$ $I_{m-1}$ and Im and the electrode distance $d_2$ between the discharge starting address electrodes ($K_{11}, \ldots K_{nm}$) and one discharge maintaining electrodes ($I_1, I_4, \ldots I_m$) are reduced too far, there may be maintained the plasma discharge space by the partition walls 30 on the second substrate 24 side. That is, since the fluorescent layer 25 may be formed at the position distant from the plasma, the plasma produce by discharge may be prevented from contacting with the fluorescent layer 25, accordingly, the fluorescent layer 25 may be prevented from being bombarded by electric charge particles in the plasma, and the fluorescent layer 25 may be prevented from being deteriorated. Accordingly, it is possible to obtain an extremely-thin and high-definition plasma display device.

Since the discharge maintaining electrode groups ($I_1, \ldots$ $I_m$, the address electrode groups ($J_1, \ldots J_n$) and the discharge starting address electrode groups ($K_{11}, \ldots K_{nm}$) are formed on the same substrate, i.e. the first substrate 22, the partition walls 30 and the fluorescent layer 25 are formed on the second substrate 24 side and the two substrates 22 and 24 are sealed, thereby resulting in the display device 21 being arranged, the accurate positioning between the electrodes may be determined, the accurate positioning required when the two substrates 22 and 24 are sealed may be obtained and the large tolerance range of space interval may be obtained, and the process for forming the electrodes and the process for sealing the two substrates or the like may be executed with a sufficient freedom. Accordingly, the yield of the display device 21 may be increased, and a cost thereof may be decreased.

Since the discharge maintaining electrode groups ($I_1, \ldots$ $I_m$) and the discharge starting address electrode groups ($K_{11}, \ldots K_{nm}$) are formed on the same surface of the first substrate 22, the distance $d_1$ between the pair of the discharge maintaining electrode groups and the distance $d_2$ between one discharge maintaining electrode I and the discharge starting address electrode K may be set with a high accuracy.

Since the address electrode J and the discharge starting address electrode K are continuously formed at the same, as compared with the arrangement in which the address electrode J and the discharge starting address electrode K are individually formed and both of them are connected, the electrode structure may be simplified, and the address electrodes J and the discharge starting address electrodes K may be conducted highly reliably. Further, the electrode manufacturing process may be simplified.

Then, when the discharge maintaining electrodes ($I_1, \ldots I_m$) are formed of the laminated layer of Cr and Al, e.g. Al/Cr two layer film structure or Cr/Al/Cr three layer film structure, since in the firing process to form the stripe-like insulator layer 27 before the address electrodes J are formed, only the surface of the upper Cr film 28 is oxidized, it is possible to avoid that the discharge maintaining electrodes ($I_1, \ldots I_m$) themselves are oxidized and sublimated.

In this connection, when the discharge maintaining electrodes ($I_1, \ldots I_m$) are made of an Al single film, for example, in order to prevent the discharge maintaining electrodes ($I_1, \ldots I_m$) from being oxidized and becoming bad conductors in the process in which the insulator film 27 is fired at about 600° C., such an arrangement is considered in which after the discharge maintaining electrodes I and the discharge starting address electrodes K are formed, the insulator film for preventing oxidization made of $SiO_2$ or the like is formed on the whole surface, the insulator layer 27 is formed and further the address electrodes J are formed. In this case, there is required a process for forming a contact-hole through the insulator layer so as to make a conduction between the address electrode J and the discharge start address electrode K. However, according to this embodiment in which the discharge maintaining electrodes I are each formed of the laminated layer of Cr and Al, such insulator film need not be formed, and the process for forming the contact-hole through the insulator film becomes unnecessary, thereby resulting in the process being simplified.

Further, when the discharge maintaining electrodes I are each formed of the laminated layer of Cr and Al, after the electrode substrate 23 and the fluorescent substrate 26 are sealed together, if the oxide film 53 on the surface of the terminal portion 51 of the discharge maintaining electrodes I is removed, then the succeeding connection between the terminal portion 51 and the outside interconnection, i.e. the terminal portion and the outside interconnection may be conducted highly-reliably.

Accordingly, it is possible to provide a high-definition and highly-reliable display device.

Since the distances $d_1$, $d_2$ between the electrodes of the respective pairs of discharge maintaining electrodes I and the discharge starting address electrodes K are set with a high accuracy, it is possible to prevent discharge light-emission from being fluctuated due to an error caused when the electrode substrate 23 and the fluorescent substrate 26 are assembled.

That is, even if the fluorescent substrate 26 is assembled with the electrode substrate 23 with an inclination and the interval between the electrode and the fluorescent layer is fluctuated in the unit discharge region, the electrode distances $d_1$, $d_2$ are the same in each unit discharge region and the discharge condition is maintained the same. In addition, since a transmittance of ultraviolet rays is satisfactory in the sealed gas, a brightness of light-emission may be prevented from being fluctuated, and the whole of the display region may be made luminous with a uniform brightness. Accordingly, there is then the practical advantage that this display device 21 may be manufactured with ease.

Since the oxide magnesium (MgO) film 29 acts to lower the work function, if the oxide magnesium film is formed on the surface of the dielectric layer 28, then discharge may be produced with ease.

Since the electrode distances $d_1$, $d_2$ may be made less than 50 $\mu$m, e.g. 5 $\mu$m to 20 $\mu$m, further reduced to be less than 5 $\mu$m and less than 1 $\mu$m, there may be obtained a display device of a higher definition.

If the electrode distances $d_1$, $d_2$ are made less than 50 $\mu$m, e.g. 5 $\mu$m to 20 $\mu$m, further less than 5 $\mu$m and less than 1 $\mu$m and a sealed gas pressure is increased to 0.8 to 3.0 atm., then as a result, a large amount of ultraviolet rays are produced to cause the fluorescent layer 35 become luminous with a high brightness.

If the distance $d_2$ between the discharge maintaining electrode and the discharge starting address electrode falls within ±30% relative to the distance $d_1$ between the pair of discharge maintaining electrodes, then the discharge starting voltage may be varied smoothly in response to the distance $d_2$, and the driving conditions may be set with an increased freedom.

Also, if the electrode distance $d_1$ and the electrode distance $d_2$ both fall within ±30% of the optimum value, then the fluctuation of the discharge voltage may be suppressed to be small. Therefore, upon manufacturing, the discharge maintaining electrodes ($I_1, \ldots I_m$) and the discharge starting address electrodes ($K_{11}, \ldots K_{nm}$) may be formed with a sufficient freedom.

Since the address electrodes ($J_1, \ldots J_n$) are formed on the discharge maintaining electrodes ($I_1, \ldots I_m$) through the insulator layer formed of the dielectric layer 28, the discharge maintaining electrodes ($I_1, \ldots I_m$) and the address electrodes ($J_1, \ldots J_n$) crossing the discharge maintaining electrodes may be insulated from each other highly-reliably, and may be prevented from being short-circuited.

Since the thickness $t_1$ of the dielectric layer 28 is thinner than the electrode distances $d_1$ and $d_2$, discharge may be produced above the dielectric layer. That is, discharge is not produced between the electrodes within the dielectric layer 28, accordingly, discharge may be produced above the dielectric layer without causing a dielectric breakdown between a pair of discharge maintaining electrodes or one discharge maintaining electrode and the discharge starting address electrode.

Since the partition walls 30 on the second substrate 24 side are formed at the positions corresponding to the address electrodes ($J_1, \ldots J_n$) on the first substrate 22 side and the width of the partition wall 30 is formed to be wider than those of the address electrodes ($J_1, \ldots J_n$), the opening of the unit discharge region may be increased, and discharge becomes difficult to be directly produced in the address electrodes ($J_1, \ldots J_n$) so that a cross-talk may be prevented. Also, by the partition walls 30, it is possible to maintain the discharge space sufficiently.

Since the plasma discharge space may be maintained by the electrode substrate 23 and the opposing fluorescent substrate 26 in which the partition walls 30 and the fluorescent layer 25 are formed, sufficient ultraviolet rays may be irradiated and the fluorescent layer 25 may be formed on the whole within the adjacent partition walls 30, the display of high luminance may be obtained as well as the wide area of the fluorescent layer 25 may be obtained.

While the present invention is applied to the color AC-type PDP in the above-mentioned embodiments, the present invention may be applied to a monochromatic AC-type PDP.

Also, while the present invention is applied to the display device in which the fluorescent layer is excited to become luminous in the above-mentioned embodiments, the present invention is not limited thereto, and may also be applied to a display device in which the fluorescent layer is not formed and which becomes luminous by plasma discharge.

According to the display device of the present invention, in the alternating-current driving-type display device using the plasma discharge, since the discharge maintaining electrode group and the address electrode group are formed on one same substrate, even when the electrode distance between the address electrode and the discharge maintaining electrode is decreased too far, the plasma discharge space may be maintained. Accordingly, it becomes possible to make the display device become extremely thin and to make pixels become high-definition.

The address electrode group crossing the discharge maintaining electrode group through the insulator layer and the discharge starting address electrode group are continuously formed at the same time, whereby the electrode structure may be simplified and the electrode forming process may be simplified.

Then, since the discharge maintaining electrode group and the discharge starting address electrode group are formed on the same surface of one substrate, the distance between the respective pairs of discharge maintaining electrodes and the distance between one discharge maintaining electrode and the discharge starting address electrode may be set with a high accuracy.

Accordingly, the process for forming the electrodes and the process for sealing one substrate and the other opposing substrate or the like may be executed with a large freedom. Therefore, the yield of the display device using the plasma discharge may be increased, and the cost thereof may be reduced.

Since the discharge maintaining electrode group and the address electrode group cross with each other and the insulator layer is formed between the discharge maintaining electrode group and the address electrode group, the discharge maintaining electrode group and the address electrode group may be prevented from being short-circuited.

Since the discharge maintaining electrode group, the discharge starting address electrode group and the address electrode group are formed on one substrate and the fluorescent layer is formed on the other substrate opposing thereto, even when the electrode distance is reduced too far, the plasma discharge space may be maintained, and the fluorescent layer may be excited to become luminous by ultraviolet rays generated by the plasma.

Then, since the fluorescent layer is prevented from contacting with the plasma generated by discharge, the fluorescent layer may be prevented from being deteriorated, accordingly, it becomes possible to make the display device, which becomes luminous based on the fluorescent material, become extremely thin and to make pixels become high-definition.

When the discharge maintaining electrode group is formed of the laminated layer of Cr and Al, in the firing process required when the insulator layer is formed, only the surface of the laminated film is oxidized, thereby preventing the whole of the discharge maintaining electrode from being oxidized. At the same time, it is possible to prevent the whole of the terminal portion of the discharge maintaining electrode group from being oxidized. Accordingly, it is possible to provide a highly-reliable display device.

When the discharge maintaining electrode group is formed of the laminated film of Cr and Al and the oxide film on the surface of the terminal portion is removed, the terminal portion of the discharge maintaining electrode group and the outside interconnection may be conducted reliably.

Having described preferred embodiments of the present invention with reference to the accompanying drawings, it is to be understood that the present invention is not limited to the above-mentioned embodiments and that various changes and modifications can be effected therein by one skilled in the art without departing from the spirit or scope of the present invention as defined in the appended claims.

What is claimed is:

1. In an alternating-current-driving type display device utilizing plasma discharge, said display device characterized in that a discharge maintaining electrode group composed of a plurality of discharge maintaining electrodes and an address electrode group composed of a plurality of address electrodes are formed on one substrate, said address electrode group crossing said discharge maintaining electrode group through an insulator layer and a discharge starting address group composed of a plurality of discharge starting address electrodes comprising a part of said address electrode group are continuously formed at the same time, said discharge maintaining electrode group and said discharge starting address electrode group are formed on the same plane, and dielectric layers are formed on said discharge maintaining electrode group, said address electrode group and said discharge starting address electrode group.

2. A display device according to claim 1, characterized by further comprising a fluorescent layer is formed on the other substrate opposing said one substrate.

3. A display device as claimed in claim 1, characterized in that said discharge maintaining electrode group is formed of a laminated layer of Cr and Al.

4. A display device as claimed in claim 2, characterized in that said discharge maintaining electrode group is formed of a laminated layer of Cr and Al.

5. A display device as claimed in claim 3, characterized in that said discharge maintaining electrode group composed of said laminated layer of Cr and Al has a terminal portion from which a surface oxide film is removed.

6. A display device as claimed in claim 4, characterized in that said discharge maintaining electrode group composed of said laminated layer of Cr and Al has a terminal portion from which a surface oxide film is removed.

7. A display device according to claim 1, characterized in that said plurality of discharge maintaining electrodes and said discharge starting address electrodes are arranged by the following relationship:

$$2t_1<d_1, \text{ and } 2t_1<d_2$$

where $t_1$ is a thickness of said dielectric layers formed on said plurality of discharge maintaining electrodes and on said discharge starting address electrodes, $d_1$ is a distance between a pair of said discharge maintaining electrodes, and $d_2$ is a distance between one of said pair of said discharge maintaining electrodes and one of said plurality of discharge starting address electrodes.

8. An alternating-current-driving type display device utilizing plasma discharge comprising:

a plurality of discharge maintaining electrodes;

a plurality of address electrodes; and a plurality of discharge starting address electrodes formed integrally from said plurality of address electrodes, wherein said plurality of discharge maintaining electrodes, said plurality of address electrodes, and said plurality of discharge starting address electrodes are formed on one substrate, said plurality of discharge maintaining address electrodes and said plurality of discharge starting address electrodes being formed on the same plane.

* * * * *